United States Patent [19]

Renfro

[11] 4,163,553

[45] Aug. 7, 1979

[54] TENNIS RACKET AND STRINGING METHOD

[76] Inventor: Robert Renfro, P.O. Box 1085, Sun Valley, Id. 83353

[21] Appl. No.: 774,580

[22] Filed: Mar. 4, 1977

[51] Int. Cl.[2] ..... A63B 51/00

[52] U.S. Cl. ..... 273/73 D; 273/73 A; 273/73 E

[58] Field of Search ..... 273/73 R, 73 C, 73 D, 273/73 E, 96 D, 29 B, 73 A

[56] References Cited

U.S. PATENT DOCUMENTS

| | | | |
|---|---|---|---|
| 323,608 | 8/1885 | Turner | 273/73 D |
| 1,663,039 | 3/1928 | Craven | 273/73 E |
| 1,863,059 | 6/1932 | Jaffe | 273/73 A |
| 2,028,663 | 1/1936 | Harroff | 273/73 A |
| 2,039,138 | 4/1936 | Auer | 273/96 D |

FOREIGN PATENT DOCUMENTS

| | | | |
|---|---|---|---|
| 784057 | 4/1935 | France | 273/73 E |
| 981444 | 1/1951 | France | 273/73 D |
| 3127 | of 1885 | United Kingdom | 273/73 D |
| 224964 | 11/1924 | United Kingdom | 273/73 D |
| 269092 | 4/1927 | United Kingdom | 273/73 D |
| 415591 | 8/1934 | United Kingdom | 273/29 B |

*Primary Examiner*—Richard J. Apley

*Attorney, Agent, or Firm*—Knobbe, Martens, Olson, Hubbard & Bear

[57] ABSTRACT

A tennis racket head is strung with string sections between frame support points formed into zig-zag segments which have multiple junction points with other string sections to hold the strings in the zig-zag pattern. In a preferred embodiment, the segments are arranged in parallel tiers, and weave over and under intermediate strings between junctions. An apparatus and method for stringing the racket is included. A simple tension adjustment can be added to the racket, which adjusts the tension over the entire playing surface.

15 Claims, 10 Drawing Figures

FIG. 2.
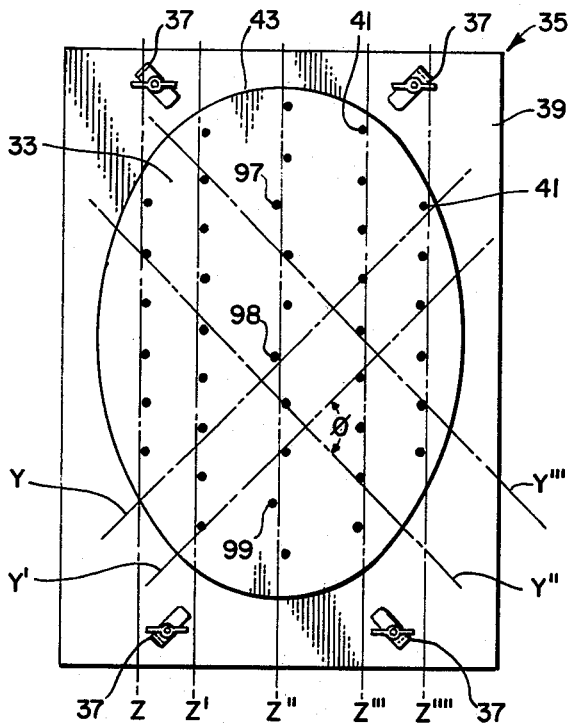
FIG. 3.
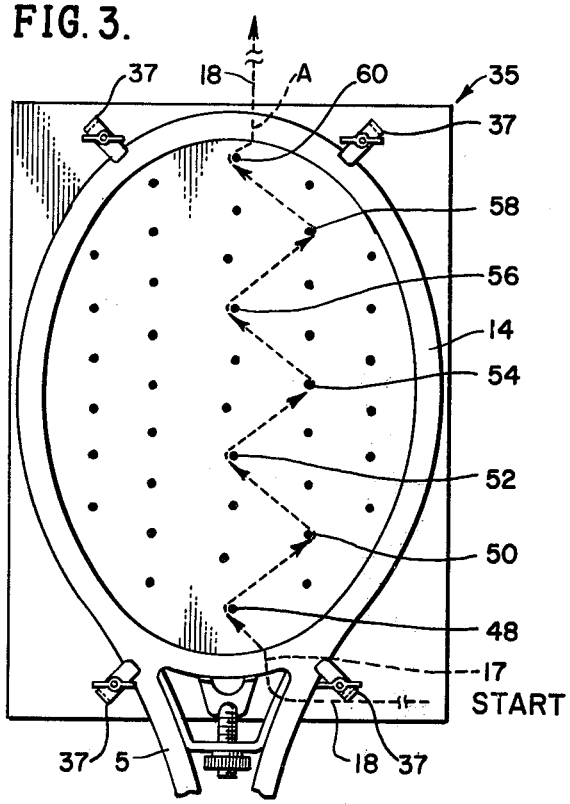
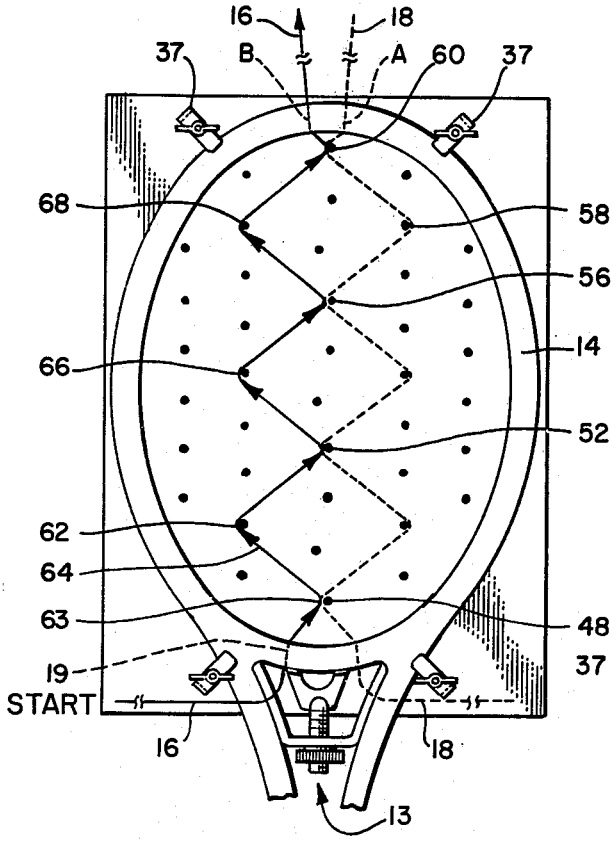
FIG. 4.
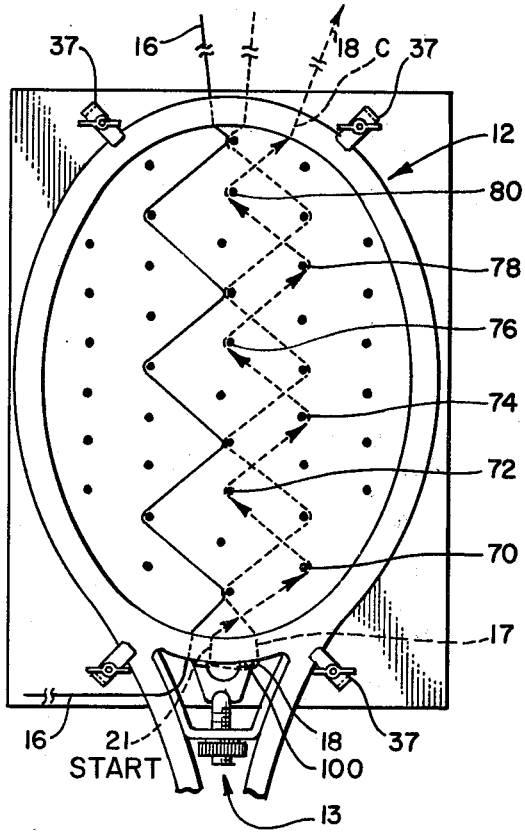
FIG. 5.

TENNIS RACKET AND STRINGING METHOD

BACKGROUND OF THE INVENTION

This invention is an improved stringing structure for tennis and similar rackets, and an apparatus and method for stringing rackets with this structure.

While new materials have been introduced in recent years for the manufacture of tennis rackets, and over the years numerous different materials have been used for stringing rackets, the actual structural placement of strings on the rackets has remained in a relatively standard pattern. In the conventional racket the strings are strung as two sets of straight strings woven above and below each other, one set strung vertically, that is, parallel to the handle, and a second set of strings strung horizontally across the racket face perpendicular to the handle. Stringing a racket in this fashion has several undesirable consequences.

First, one set of strings, namely the vertical ones, are longer than those which run horizontally. As a consequence, the two sets of strings have different resiliency properties when the strings are at uniform tension. This unfavorably affects the racket's playing characteristics. Second, the ball only responds well when it contacts two sets of crossing long strings, which is only in the small area in the center of a conventional racket. Hence, it would be desirable to have longer strings near the edge of the racket to produce a racket with good play and feel over a wider central area.

In addition, the conventional stringing structure allows the strings to move across one another which increases wear. This results in decreased lifetime for the racket and causes increased expense to the player. Thus, the player must anticipate that he will on rather frequent occasions have to replace strings due to frictional wear from the strings rubbing one another.

Since the horizontal strings are strung independent of the vertical strings, in conventional rackets, it is impossible to attach a single tension adjustment to the racket that will adjust all the strings. Except for a few rackets that have tension adjusters for the vertical strings, the racket is generally restrung in order to adjust the tension, not just tightened or loosened. A simple stringing method that allows for tension adjustment of all the strings at the court is one which is highly desirable.

Additionally, a racket should have as little vibration as possible during play. A principal cause of sore tennis elbow is the vibration from the racket to the arm. A method of stringing the racket which would reduce racket vibration in the handle, and a corresponding reduction in vibration transmitted to the player's arm, will result in a racket that is safer and more comfortable playing.

Other playing characteristics of a tennis racket are affected by the stringing method. For example, it is desirable to have a racket that plays well with less string so that wind resistance on stroking the ball is lessened, resulting in a faster and more powerful stroke. Also, since the sound of the ball hitting the racket plays a role in the reactions of the receiving player, a racket which has less sound upon impact of the ball increases a player's advantage.

While the stringing method disclosed in this application does not completely eliminate all of the problems present in the prior art, the new and novel method disclosed for stringing tennis rackets herein reduces considerably these problems which have been encountered in the prior art but which over a long period of time have not been solved.

SUMMARY OF THE INVENTION

An improved tennis and sports racket is disclosed which has an improved structural arrangement of the strings on the racket. The strings are held in the racket in a broken line or zig-zag pattern so that string sections do not cross the racket in a straight line between the two points where they connect to the racket frame.

In a preferred embodiment, the strings are held in the broken line or zig-zag pattern by forming interlocking elbow-like junctions with each other. Additional embodiments of the stringing structure include weaving the strings among various intermediate strings between the formation of the interlocking junctions which hold the strings in the zig-zag pattern. In all of these embodiments the strings are diagonal to the vertical and horizontal axes of the racket. This bias generally causes the racket to impart a different spin to the ball than that caused by executing the same stroke with a racket having strings which are only parallel and perpendicular to the axis of the handle.

An apparatus and method for stringing rackets in a zig-zag string pattern are also disclosed. The method uses peg guides to hold the strings until the zig-zag segments can be locked into position by a junction with another string segment and secured to the racket frame. The apparatus uses a base with peg-like guides to hold the strings in place.

The disclosed invention has among its objectives the formation of a string structure which has longer continuous strings stretching between connection points on the racket which reduces vibration while playing, increases power, can be strung with less string to reduce the air resistance of the racket, has an increased playing lifetime due to reduced wear from frictional rubbing of the strings across each other and a larger central playing area where the racket plays well and comfortably, that is, a larger central "sweet spot" for hitting the ball. Finally, the structure disclosed herein makes less noise upon contacting the ball, and so gives a player a tactical advantage in actual practice. A simple tension adjustment may also be provided, which adjusts the tension in all the strings from one point.

DESCRIPTION OF THE DRAWINGS

FIG. 2 is a plan view of a guide used to string the racket;

FIGS. 3 through 7 are plan views of the racket head in various stages of the stringing process;

DETAILED DESCRIPTION OF THE PREFERRED EMBODIMENT

Figures 1, 10:
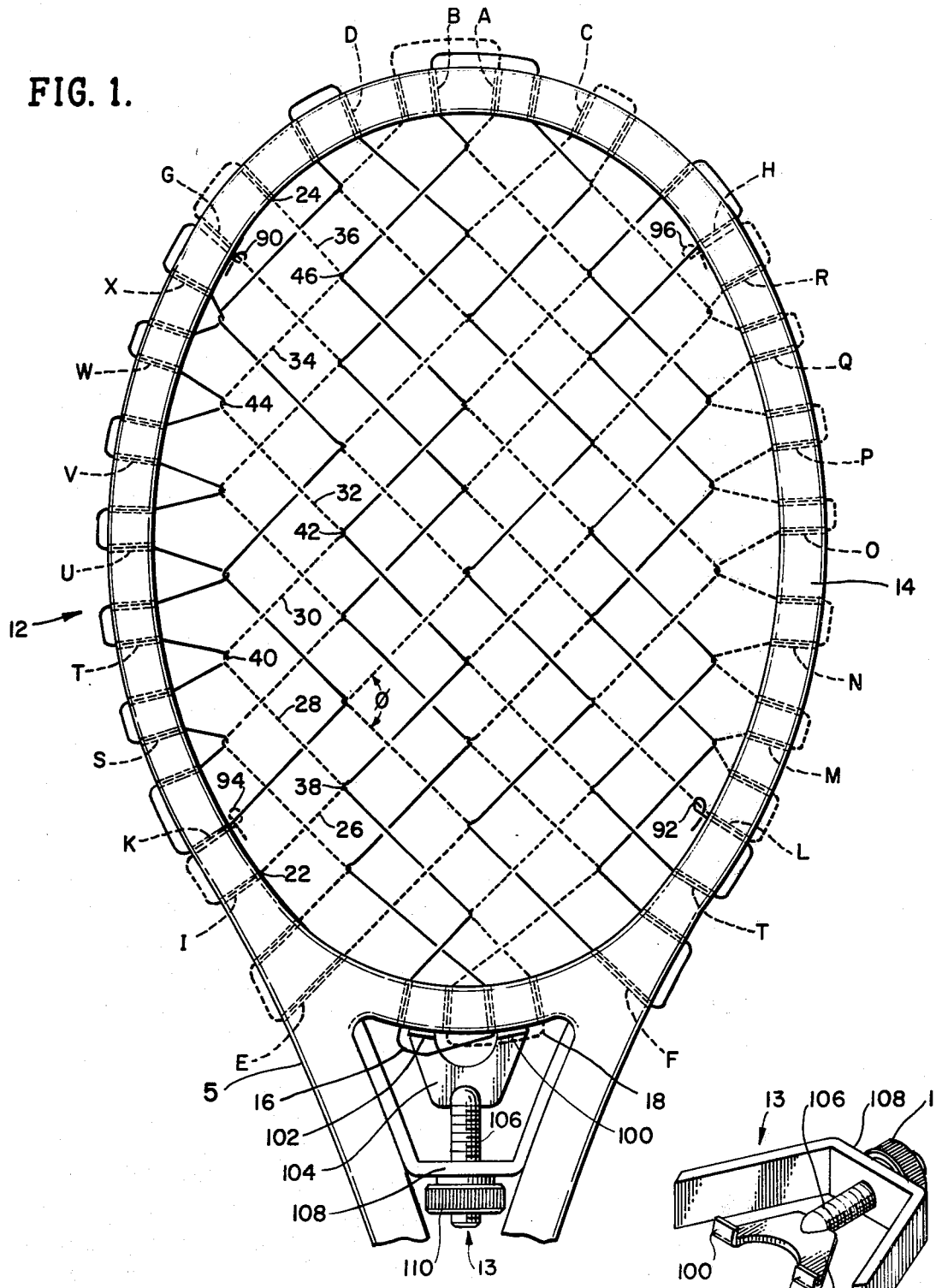
FIG. 1 is a plan view of the racket head of this invention.
FIG. 10 is a perspective view of a tension adjustment apparatus.

Referring to FIG. 1, a tennis racket head 12, using only two continuous strings 16 and 18, is strung according to the novel structure of the instant invention. The racket has a string support frame 14, identical to frames commonly in use, except that the holes for attachment of the strings 16,18 are differently located. To aid in understanding the stringing arrangement, string 18 has been drawn as a dashed line, it being understood that it is in fact a continuous string identical to the string 16.

In contrast to the conventional method of stringing tennis rackets, the sections of strings 16 and 18 spanning between two points of support on the frame 14 are not stretched in a straight line spanning the two points, but are formed into broken or zig-zag line segments; that is, they are stretched to form a plurality of substantially straight line segments that join at given points or junctions. Thus, the frame 14 is strung using two strings, 16 and 18, each divided into string sections. Each string section is further divided into plural zig-zag string segments. For example, the section of string 18 extending between the support points 22 and 24 of the racket frame 14, has a plurality of substantially linear string segments 26, 28, 30, 32, 34, and 36. These extend in pairs in different directions from plural junction points 38, 40, 42, 44, and 46. Each junction 38–46 is formed by an intersection with segments of string 18.

The racket may be strung with two separate strings, 16 and 18, each looped around a tension adjustment mechanism 13, the purpose of which will become apparent below.

The details of the string structure or mesh may be best understood by following the step-by-step construction of the string structure illustrated in FIG. 1, with the general outlines of the finished product in mind as this step-by-step process is described.

FIG. 2 illustrates a guide for stringing the racket of FIG. 1. The guide 35 has a base 39 which holds a plurality of pegs 41. The central portion 33 of the base may, preferably, be slightly raised to form a raised area having a perimeter 43 shaped to fit the inside perimeter of the racket frame to be strung. This helps hold the racket frame in position. The pegs 41 are located on the base 39 to guide and hold the strings in position until the stringing process is completed; the details of selecting the peg's positions will be described below. In a preferred embodiment the pegs 41 are allowed to rotate about their own axis to facilitate stretching the strings in place. Although the pegs 41 may also be simply fixed in place, it is advantageous to removably attach them to the base so they may be individually removed to avoid the high friction encountered in removing the racket from the base with all pegs in place.

Referring to FIG. 3, the racket frame 14 is shown placed over the guide 35. The racket frame 14 may be clamped to the guide 35 by clamps 37 of any conventional form, or the racket and guide may otherwise be held in a fixed position relative to each other in a racket stringing device. The string 18, about ten feet in length, is passed through a hole 17 labelled START in the frame 14 and is passed around the peg guides 48, 50, 52, 54, 56, 58, and 60 in a zig-zag fashion, and out the hole A at the top of the racket. Arrows shown on the string indicate the direction of stringing. The string 18 alternately bends to the right and then to the left as it is strung. Thus, the two segments at the ends of an intermediate segment each lay in the plane of the racket head on opposite sides of a straight line defined by the intermediate segment. Approximately half the string 18 will not be placed through the frame 14 but is temporarily left free. At this point the string may also be lightly tightened to facilitate subsequent stretching in place.

Referring to FIG. 4, the first section of string 16 is now strung in place. This section is placed through the hole 19, and then forms an interlocking junction 63, described below, with string 16 next to peg 48. The string 16 then passes around the peg guide 62 to form a straight segment 64 between pegs 48 and 62. As in FIG. 3, in FIGS. 4–7 the direction of stringing is indicated in the drawings by the label START, and arrows on the string.

Figure 8:
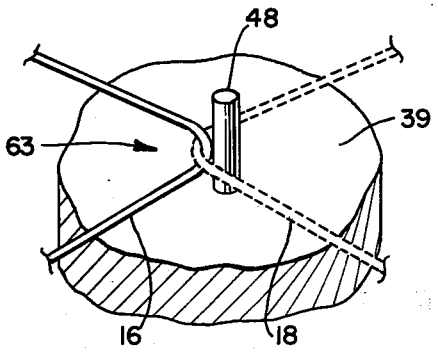
FIG. 8 is a detail of the interlocking junctions formed by two string sections.

Referring now to FIG. 8, a detail of the interlocking structure formed by strings 16 and 18 at the peg 48 is shown. The string 18 passes around peg 48, and is tightened so that it rests against the peg 48. The string 16 is then passed around the string 18 to form two elbow-like bends, one in each of the strings 16 and 18, which mutually hook and interlock the strings together. After the strings 16,18 are stretched tautly within the frame 14, as is done during the stringing process, the interlocking junction 63 holds the strings in position within the racket frame 14, and peg 48 no longer supports either string 16 or 18. For purposes of definition, string 16 in FIG. 8 may be said to be bent to point to the right of string 16, while string 18 in FIG. 8 may be said to be bent so that it points to the left of string 18. As will become apparent below, adjacent interlocking junctions, in the preferred embodiment, are formed so that adjacent bends of a single section each point to opposite sides of a string section.

Returning to FIG. 4, the string 16 is now strung up the racket alternately interlocking with the string 18, next to the pegs 52, 56, and 60, and passing around the peg guides 66 and 68 to form a set of connected straight segments spanning the racket frame 14 between the holes 19 and B.

Referring now to FIG. 5, a second section of string 18 is now strung through frame 14. The end of the string 18, which was not previously strung through hole 17, is placed over the hook 100 of the tension adjustment 13, and then is passed through a hole 21 in the racket 14. The string 18 is then laid over the previously strung portion of string 18 and hooks around guide pegs 70, 72, 74, 76, 78, and 80, as it continues on up the racket head 12 in a zig-zag fashion, ultimately passing through a hole C at the top of the racket. At this point the string 18 may be secured and conventionally tensioned to form a taut string suitable for playing tennis.

Figure 6:
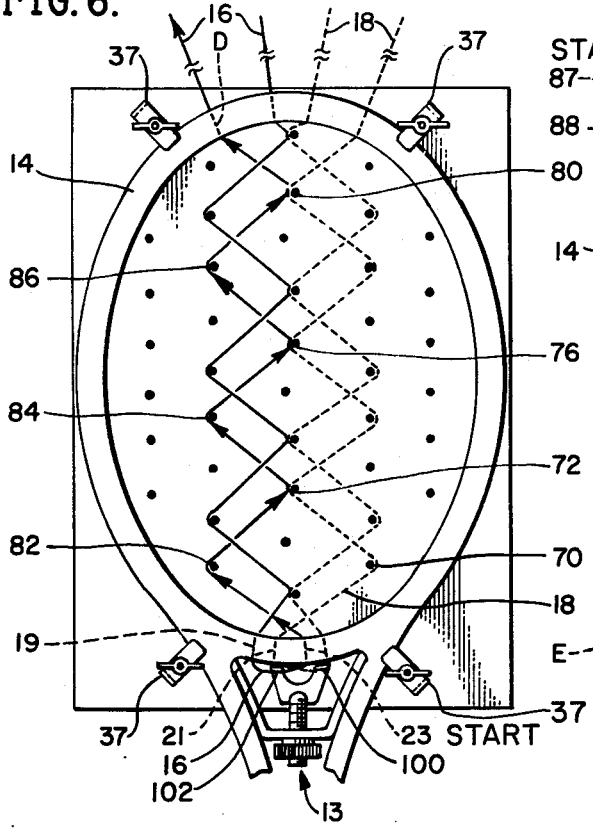

Referring to FIG. 6, a second section of string 16, formed from the previously unstrung end of string 16, is added to the racket. This section goes around the hook 102 of the tension adjustment 13 and through a hole 23 in the racket frame 14, passing over the short segment of string 18 which lies between the hole 21 and the peg 70. Hereafter, this second section of string 16 is passed under the previously strung segments of string 16 alternately hooking around the guide pegs 82, 84, and 86 and interlocking, as described above, with the string 18 next to pegs 72, 76, and 80, until it passes through a hole D in the racket frame 14. The string 16 may be conventionally tightened at this point.

An alternative method of stringing this racket would be to place this second section of string 16 in position before placing the first section, described above, in position. If this alternative order is followed, the first section described above can be placed on top of the second section, rather than having to pass the second section below the first. This alternative order may be slightly faster to string.

Figure 7:
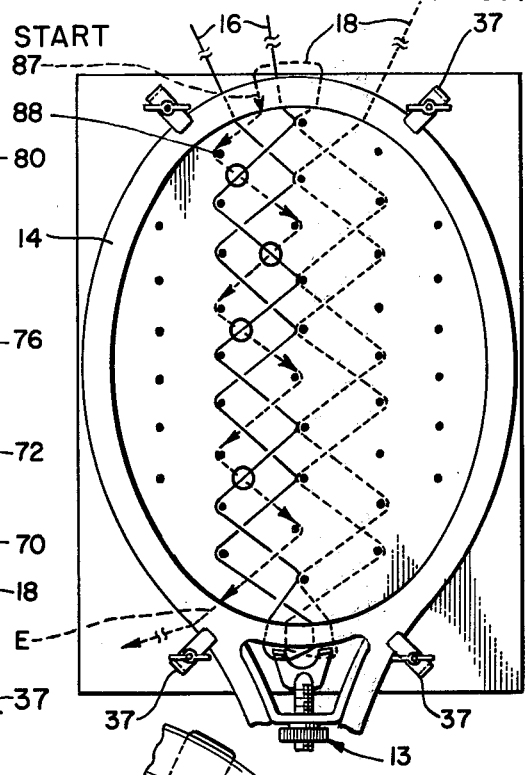

Referring now to FIG. 7, the racket is viewed with another section of string 18 added to the frame 14 between a pair of holes 87 and E. This section, after placement through the hole 87, is first passed under the string 16 and then around guide peg 88. Moving down the racket toward the handle, this section of string 18 crosses in sequence two previously strung segments between each pair of pegs. In each instance it weaves underneath the first of the two string segments and over the second intermediate string segment. After weaving under and over the intermediate strings between pegs, the string 16 changes directions by wrapping around each guide peg, and continues the zig-zag pattern common to the other sections previously strung until the string reaches the racket frame 14 and passes through the hole E in frame 14.

The remainder of the racket is similarly strung until the structure drawn in FIG. 1 is completed. It should be understood that in FIG. 1, breaks in the lines illustrating strings 16 and 18 where they cross another string indicate that the broken line string passes under the string which it is crossing. The alphabetical order of the labeling of the holes in the racket 14 indicates the order in which the string segments were placed in the frame 14. That is, the stringing starts at the yoke 5 of the racket. The segment in passage A is the first to be put in place as shown in FIG. 3, and goes from the yoke 5, up the racket, and then out through passage A. The strings in holes B, C, and D are similarly strung through the racket and on the guide pegs, in that order, as shown in FIGS. 3–5. The remaining strings are then strung through the racket in the alphabetical order in which the holes are labeled.

In the preferred embodiment, strings 16 and 18 interlock only with each other and not with themselves except near the frame where they interlock with the short two-segment sections. This results in a more uniform tension transfer.

After the stringing is completed, and stretched tautly into place, the ends of the strings 16 and 18 are knotted at ties 90 and 92, and 94 and 96, respectively as illustrated in FIG. 1. To facilitate tightening the strings, in the preferred embodiment, the segments do not make an angle substantially in excess of 45° with an axis along the general direction of travel of the string section, i.e., along an axis running between the two points where the string is supported to the racket frame. This makes it possible to easily tension a section having more than three segments after it is completely strung in place, without having to tension each segment separately.

Referring to FIGS. 1 and 10, the tension adjustment 13 has two hooks, a hook 100 and a hook 102, to which the strings 16 and 18 respectively are hooked during the stringing process. The hooks 100,102 are fastened to a member 104. The member 104 is fixed to a threaded bar 106.

The bar 106 passes through a hole in a cross support 108 which is fixed inside the racket throat. A nut 110 is threaded onto the bar 106 and rests against the side of the cross support 108 which is opposite the hooks 100,102.

Threading the nut 110 on the bar 106 causes the hooks 100,102 to pull the sections of string 16 and 18 which pass through holes A, B, C, and D from the yoke 5. These sections and their segments interlock directly with every other segment on the racket except for the short two segment sections along the edge of the raket. Hence, when these strings are pulled, they pull at these interconnections, and thereby pull the other string sections on the racket. Thus, the tension on the entire string playing surface can be adjusted, by moving the threaded bar 106 through rotating the nut 110.

Figure 9:
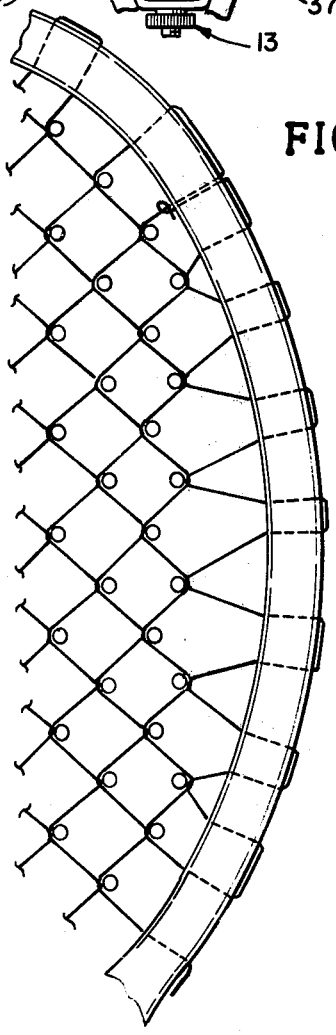
FIG. 9 is a partial plan view of an alternate embodiment for a racket made according to this invention.

FIG. 9 shows a detail of an alternative embodiment in which the strings do not weave across any intermediate strings, but interlock together at every possible intersection. This racket takes a longer time to string, and has this as its disadvantage relative to the preferred embodiment of this invention. In addition, the increased frictional drag because of the increased number of interlocks makes tensioning more difficult.

The selection of placement points for the pegs 41 in the guide 35 can now be understood. Referring to FIG. 8, it may be seen that the peg 48 is placed to form a support for the first string put in place, string 16 in FIG. 8, at the point where the string bends. The remainder of the peg is positioned within the elbow-like bend of the string where it will not interfere with the travel path of the string. Thus, the center of the peg preferably lies on a line bisecting the angle formed by the elbow-like bend, and has a small area on its outer surface positioned next to the point where the bend is to form.

A guide for any interlocking string structure can be created by simply placing a drawing of the string structure, or the actual racket, on a base. The peg guides are located within the elbow bends of the first string to be placed where the interlocks occur on the desired structure as described above. The racket or drawing can then be removed and guide pegs affixed to the base. Thus, a guide pattern for a racket in which there is one intermediate string between interlocking junctions can be easily designed as well as one where the interlocking junctions occur without the string passing over any intermediate segments between junctions.

In the preferred embodiment, the string structure of a tennis racket will show a high degree of symmetry. The strings will normally be symmetrically positioned on the racket with respect to axes bisecting the racket head vertically, that is, parallel to the racket handle, and horizontally, that is, perpendicular to the axis handle.

Referring to FIG. 2, it may be seen that the guide for making the racket of this invention also reflects these symmetries. The surfaces of the peg guides which support the strings during the stringing process all lie substantially on straight lines parallel to the racket handle, as shown in FIG. 2 by the axes Z, Z′, Z″, Z‴, and Z⁗. These axes are also distributed symmetrically with respect to the vertical axis of the racket.

During the actual stringing, the most convenient order for placing the strings on the racket will cause the formation of the interlocking intersection to be on the left side of some of the guide pegs, and on the right side of others. To account for this, the guide pegs 97, 98, and 99 have been offset slightly to the left of the axis Z″, and the remainder along this axis have been offset to the right. These correspond to the formation of the intersections on the left and right side of the pegs, respectively. By offsetting the pegs in this manner, the intersections will be formed substantially in straight lines. Obviously, if the guide pegs are small in diameter, aligning the pegs with their centers in a straight line will introduce only a small asymmetry, which may be unnoticeable in the racket finally produced.

In addition to the above symmetry, the surfaces of the peg guides which support the strings all lay substantially on parallel diagonal lines corresponding to the directions taken by the string segments, as illustrated by the parallel lines Y, Y′, and Y″, Y‴. The distance between pegs on these lines will determine the length of the sub-segments. The angle $\phi$, formed by the intersection of these lines, is the angle at which the pair of straight sub-segments will diverge from the interlocking junctions, when the racket is finally strung.

Rackets made according to the instant invention have several unusual features. A racket can be constructed without any strings proceeding in a straight line across the racket face. As a consequence, the strings are much longer than on a conventional racket. For example, in FIG. 1, where the angle $\phi$ between the string sub-segments is 90°, the string is over 40% longer than the straight line distance across the racket frame.

Another property of the string structure of FIG. 1 is that it has, in a sense, no horizontal zig-zag playing strings. By this it is meant that the projection of a straight line between two points of support of a string section on a vertical axis parallel to the racket handle will be greater than the projection of such a line on a horizontal axis perpendicular to the vertical axis. For example, referring to FIG. 1, a straight line drawn between the support points 22 and 24 of a section of string 18 clearly has a projection on a vertical axis parallel to the general axis of the racket handle that is greater than the projection of this line on a horizontal axis perpendicular to the vertical axis. This is true of each of the string sections of FIG. 1. For purposes of definition, the vertical and horizontal axis of the racket head may be generally referred to as the cross axes of the racket. Since the horizontal distance across the racket head 12 is less than the vertical axis, this property also leads to a racket having longer string sections than the conventional racket. Since the length of the string segments affects the playing characteristics of the racket, this gives the racket a much more uniform feel over its entire playing surface. Thus, the desirable playing area, or "sweet spot", of the racket appears to be enlarged.

Less total string is needed for a racket strung according to the structure of this invention. Because the string sections are broken into small, fixed segments, each segment forms a firmer playing surface than does a single long string. Thus, fewer strings per unit area are needed to have a firm racket playing surface, and the space between the strings may be increased. This economizes on string material costs, and also reduces the wind resistance of the racket.

By locking the strings together through the use of the interlocking junctions described above, the strings have less movement laterally across each other than in a conventional racket. This increases the useful life of the strings by reducing frictional wear. Further, by stringing a racket as disclosed herein rather than in the conventional manner, the ball strikes the strings on a diagonal imparting a different spin to the ball. Also, since in most normal stroke movements, the ball moves across the vertical strings, that is, those strings which are parallel to the handle of the racket, they wear out faster than the horizontal strings. A racket strung according to the zig-zag pattern of FIG. 1 will distribute the wear on the string more evenly.

For reasons that are not clearly understood at this time, the racket strung in this fashion transmits less vibration to the racket handle. This diminishes the discomfort of playing with a sore elbow and, in addition, helps to prevent tennis elbow.

Finally, the racket may be combined with a single simple tension adjustment, allowing the player to fine tune the playing characteristics of his racket.

What is claimed is :

1. A sports racket comprising: a string support frame, having a racket handle, and a racket head attached to said handle and defining a central opening; and a string attached to said racket head and forming a pattern within said central opening, and said pattern consisting of plural, string sections each connected between two points on said frame and extending along a straight axis through said points of connection, said axes of each section being substantially parallel to the others, and each section consisting of plural straight string segments zig-zagging along said straight axis;

elbow-like junctions formed by adjoining segments, each said elbow-like junction of each said string section interlocking with an elbow-like junction of an adjacent section.

2. The racket according to claim 1 including plural said interlocking junctions, in which more than two said junctions lying substantially on an axis parallel to said racket handle.

3. The racket of claim 1 in which each segment of each section lies along a line which forms an angle of approximately 45° with said axis of said section.

4. The racket according to claim 1 in which alternate segments of each said section are substantially parallel to each other.

5. The racket of claim 1 including means attached to said racket and directly in contact with said string for adjusting the tension of said string pattern.

6. The racket of claim 5 in which said means for adjusting the tension of said string pattern pulls said string through holes located in said string support frame.

7. A sports racket comprising:

a string support frame, having a racket handle, and a racket head attached to said handle and defining a central opening; and a string attached to said racket head and forming a pattern within said central opening, and said pattern consisting of plural, string sections each connected between two points on said frame and extending along a straight axis through said points of connection, said axes of each section being substantially parallel to the others, and each section consisting of plural straight string segments zig-zagging along said straight axis;

elbow-like junctions formed by adjoining segments, each said elbow-like junction of each said string section interlocking with an elbow-like junction of an adjacent section; and at least some of said string segments crossing string segments of other string sections between interlocking junctions.

8. A sports rack comprising:

a string support frame, having a racket handle, and a racket head attached to said handle and defining a central opening; and a string attached to said racket head and forming a pattern within said central opening, and said pattern consisting of plural, string sections each connected between two points on said frame and extending along a straight axis through said points of connection, said axes of each section being substantially parallel to the others, and each section consisting of plural straight string segments zig-zagging along said straight axis;

elbow-like junctions formed by adjoining segments, each said elbow-like junction of each said string section interlocking with an elbow-like junction of an adjacent section; and at least some of said string segments crossing plural string segments of adjacent string sections between interlocking junctions, said string segments alternately weaving above and below said plural string segments between junctions.

9. A sports racket comprising:

a string support frame, having a racket handle, and a racket head attached to said handle and defining a central opening; and a string attached to said racket head and forming a pattern within said central opening, and said pattern consisting of plural, string sections each connected between two points on said frame and extending along a straight axis through said points of connection, said axes of each section being substantially parallel to the others, and each section consisting of plural straight string segments zig-zagging along said straight axis;

elbow-like junctions formed by adjoining segments, each said elbow-like junction of each said string section interlocking with an elbow-like junction of an adjacent section; and at least some of the segments are intermediate two segments joined at opposite ends thereof and in which the two segments which join with said intermediate segment are on opposite sides of a substantially straight line defined by said intermediate segments.

10. A method of stringing a sports racket comprising the steps of:

providing a base having multiple string guide means located thereon in a predetermined pattern to result in a zig-zag string mesh;

holding a racket string support frame in a fixed position on said base;

placing a first string section on said racket frame by stringing a string through a first hole in said frame, passing it around a first set of several said guide means to form a zig-zagged line, and running said string through a second hole in said frame, opposite said first hole;

placing a second string section on said frame between two support positions on said frame utilizing a second set of guide means, and simultaneously forming plural elbow-like interlocking junctions between said first and second string sections;

placing other string sections on said frame between two support positions and utilizing said guide means such that said other string sections interlock with and cross adjacent string sections, each string section weaving alternately over and under two string segments of other string sections until said string pattern is complete;

tightening all said string sections to form a taut string mesh.

11. A sports racket, comprising:

a frame, comprising:

a handle;

a head with a central opening; and means for attaching a string pattern to said head and within said opening; and a string attached to said head so as to form a pattern, comprising:

plural, parallel string sections attached at opposing points to said head, each section interlocking with adjacent sections at certain points along the length of said section to zig-zag along a straight line and each string section overlapping other string sections and alternately weaveing over and under other string sections.

12. A sports racket, as defined in claim 11, in which said interlocking and interweaving string sections form a string pattern within said head of uniform, diamond-shaped quadrangles.

13. A sports racket, as defined in claim 12, in which more than 1 string is attached to said head in order to form said string pattern.

14. A sports racket, as defined in claim 11, further comprising:

means attached to said frame and said string for adjusting the tension of said string, said adjusting means not affecting the points of support of said string on said frame.

15. A sports racket, as defined in claim 14, in which said means for string tension adjustment is attached to only two of said string sections.

* * * * *